US006296408B1

(12) United States Patent
Larkin et al.

(10) Patent No.: US 6,296,408 B1
(45) Date of Patent: Oct. 2, 2001

(54) PROGRAMMED MOTION WORK STATION

(76) Inventors: Stephen F. Larkin, 2233 Martin St. #312, Irvine, CA (US) 92715; Alan Booth, 10551 Wilshire Blvd., #603, Los Angeles, CA (US) 90024

( * ) Notice: Subject to any disclaimer, the term of this patent is extended or adjusted under 35 U.S.C. 154(b) by 0 days.

(21) Appl. No.: 09/058,057

(22) Filed: Apr. 9, 1998

Related U.S. Application Data

(63) Continuation-in-part of application No. 08/102,471, filed on Aug. 5, 1993, now Pat. No. 5,765,910.

(51) Int. Cl.[7] ..... B41J 11/56
(52) U.S. Cl. ..... 400/682; 400/681
(58) Field of Search ..... 400/681, 682; 361/380

(56) References Cited

U.S. PATENT DOCUMENTS 4,402,624 * 9/1983 Stahl et al. ..... 400/681
5,347,424 * 9/1994 Akahane ..... 361/680
5,541,593 * 7/1996 Arsem ..... 341/22
5,546,271 * 8/1996 Gut et al. ..... 361/680
5,564,844 10/1996 Patterson, Jr. et al. .
5,732,928 * 3/1998 Chang ..... 248/688
5,735,618 * 4/1998 Gluskoter et al. ..... 400/472

* cited by examiner

*Primary Examiner*—John S. Hilten
*Assistant Examiner*—Minh H. Chau
(74) *Attorney, Agent, or Firm*—Lyon & Lyon LLP

(57) ABSTRACT

A work station includes a work table and chair defining a work station geometry. A plurality of adjustable elements are utilized within the work station to facilitate the variation of the work station geometry. A controller is coupled to the adjustable elements of the work station to apply gradual long term motion profile signals to the adjustable elements of the work station. The work station geometry is varied in response to the imposition of the motion profile signals upon the adjustable elements of the work station to provide substantially imperceptible changes of the work station operator's physical position to avoid or minimize the many maladies associated with restricted or limited motion operation within work stations. Further, a continuous passive motion keyboard is provided to change the keyboard positioning relative to the keyboard user.

5 Claims, 5 Drawing Sheets

PROGRAMMED MOTION WORK STATION

CROSS-REFERENCE TO RELATED APPLICATIONS

This application is a continuation-in-part of application Ser. No. 08/102,471 filed Aug. 5, 1993 now U.S. Pat. No. 5,765,910.

FIELD OF THE INVENTION

This invention relates generally to human work environments and particularly to specialized working environments often referred to generally as work stations.

BACKGROUND OF THE INVENTION

One of the emerging consequences of the technological development in the workplace has been the emergence of highly specialized machines and machine control environments. These machines and machine controls such as computer controlled systems have greatly increased the productivity and efficiency of workers by grouping substantial operative and control functions within a single compact environment minimizing the amount of movement and travel required by the worker in controlling diverse and complex functions. As workplace architects and creators have endeavored to further increase the effectiveness and efficiency of workers, greater numbers of controls and functions have been more densely grouped into smaller and smaller work space type areas often referred to as work stations. Such work stations have achieved considerable variation and have included manufacturing system control facilities, computer work stations for information process, secretarial and administrative office environments as well as other facilitates throughout much of the modern industrial scene including inspection and fabrication stations on assembly line type facilities or the like.

While such highly efficient and compact work station environments have greatly increased worker productivity and efficiency, the burdens imposed upon the worker in a work station environment which essentially limits the ranges of motions encountered by the worker has also given rise to substantial risks of injury and other problems. In particular, the tendency for such work stations to utilize a restricted seating portion for the worker and the manipulation of densely compacted controls such as a computer keyboard or the like has given rise to a variety of maladies such as the well known carpal tunnel syndrome as well as a variety of musculo-skeletal ailments generally referred to as repetitive motion syndrome. One of the most common examples of such problems is the painful injury which often afflicts those operating computer keyboards for extended periods of time as the repeated high speed limited motion of the computer operator's fingers gives rise to the carpal tunnel syndrome type injury. Other familiar problems includes back and neck stress and eye strain as computer operators maintain a fixed position staring at a computer display monitor or the like.

In attempting to meet these problems, practitioners in the art have endeavored to provide work station environments which are more ergonomic and which provide improved support and adjustability of the operating environment to suit the physical dimensions and characteristics of the operator. Toward this end, practitioners have provided work station environments in which the user is able to adjust the various operating dimensions of the work space environment such as the table height, the keyboard height, the height of footrest and chair seating surfaces as well as the angle of chair back supports and the distance to the worktable and so on.

For example, U.S. Pat. No. 5,098,160 issued to Moore, et al. sets forth an ERGONOMIC SEATING SYSTEM APPARATUS which includes a linear alignment member with an interconnected seating device such as a chair. An adjustable footrest is provided in combination with the linear adjustment and alignment member. The chair and linear alignment member and footrest are positioned with respect to a workplace environment such as a desk and computer. The user is able to adjust the chair position and height as well as the footrest height independently to optimize the ergonomic position for the user.

U.S. Pat. No. 4,779,922 issued to Cooper sets forth a WORK STATION SYSTEM in which a planar base supports a multiply articulated chair having an angularly movable backrest and various adjustable independently movable support pads and surfaces. An angularly movable support is coupled to the chair and includes a computer monitor and keyboard all capable of independent adjustment.

U.S. Pat. No. 4,880,270 issued to Cooper sets forth a WORK STATION SYSTEM similar to that set forth in the above-mentioned U.S. Pat. No. 4,779,922 and which is a continuation-in-part thereof U.S. Pat. No. 5,106,141 issued to Mostashari sets forth a MOTORIZED MOBILE OFFICE for use in a van-type vehicle or the like. The interior of the van is configured to receive and support a complete work station including a support chair and a computer keyboard support together with additional surrounding work surfaces.

U.S. Pat. No. 5,122,786 issued to Rader sets forth ERGONOMIC KEYPADS FOR DESKTOP AND ARMREST APPLICATIONS in which a pair of left and right ergonomic keypads may be separately positioned on a desktop or armrest of a chair to permit the user to operate the keypads while assuming a more comfortable and natural hand and wrist position. The separate keypads may be hingedly interlockingly joined to function as a compact unitary keyboard for desktop use.

U.S. Pat. No. 4,585,363 issued to McGuire sets forth a THERAPEUTIC AID for use by a patient in developing fine, medium and gross arm movements. The device includes a pair of elongated adjustable length arms pivotally coupled at their junction and securable at one end to a chair backrest or the like. A pen or other therapeutic apparatus may be secured to the remaining end of the pivotal arm combination and serves as a guide for arm and hand movement on the part of the user.

While the foregoing described prior art devices have provided improvement over fixed inflexible work station environments, there remains nonetheless a continuing need in the art for work station environments and apparatus therefor which provide further attention to the physical needs of the user and which protect the user more substantially against the limited motion and confined motion types of injuries such as carpal tunnel syndrome or repetitive motion syndrome.

SUMMARY OF THE INVENTION

Accordingly, it is a general object of the present invention to provide an improved work station. It is a more particular object of the present invention to provide an improved work station which tends to minimize or prevent injury to the user resulting from limited and repetitive motion.

In accordance with the present invention, there is provided a programmed motion work station comprising: a worktable having a work surface and means for supporting the work surface; a chair having a seating surface; and motion means for raising and lowering the seating surface of the chair in accordance with a long term gradual motion profile.

In a separate aspect of the invention, there is provided a keyboard having a continuous passive motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
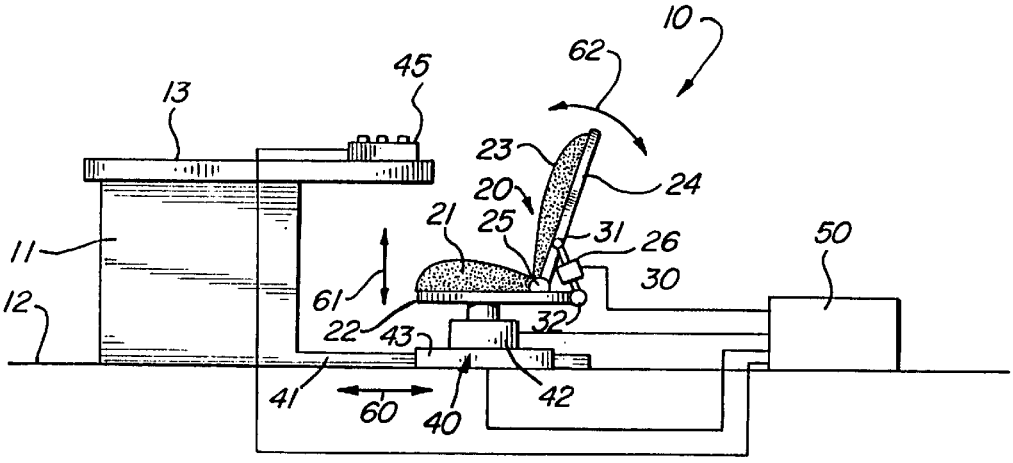
FIG. 1 sets forth a diagrammatic representation of the present invention programmed motion work station.

FIG. 1 sets forth a diagrammatic view of a work station constructed in accordance with the present invention and generally referenced by numeral 10. Work station 10 includes a work desk 11 constructed in accordance with conventional fabrication techniques and resting upon a typical floor surface 12. Desk 11 includes a generally planar desktop 13 which forms a typical work station work surface. While not seen in FIG. 1, desktop 13 may support a plurality of conventional work station apparatus such as that typically found in offices or the like including for example a computer and computer keyboard. A chair 20 includes a seat support 22 having a seat 21 secured thereto together with a back support 24 pivotally coupled to seat support 22 by a pivotal attachment 25. Back support 24 supports a back cushion 23 in accordance with conventional fabrication techniques. A back adjuster 26 is coupled to back support 24 by a pivotal attachment 31 and to seat support 22 by a pivotal attachment 32. Back adjuster 26 includes a motor driven expander 30 also constructed in accordance with conventional fabrication techniques. Chair 20 further includes a chair base 40 having an expandable height adjuster 42 secured thereto and extending upward therefrom. Height adjuster 42 comprises an expandable motor driven element of conventional fabrication which is secured to a chair support 43 which in turn is secured to the underside of seat support 22. A horizontal track 41 is secured to floor 12 and to the lower portion of desktop 13 and extends beneath chair base 40. Chair base 40 includes conventional motor driven apparatus (not shown) which engages track 41 and which moves chair base 40 and chair 20 upon track 41 either toward or away from desk 11. A motion controller 50 is coupled to back adjuster 26, height adjuster 42 and chair base 40 in an operational relationship in which controller 50 is operable to energize back adjuster 26, height adjuster 42 and chair base 40 in accordance with the present invention to provide predetermined motion thereof A control panel 45 is supported upon desktop 13 and is also coupled to controller 50.

In operation, controller 50 preferably includes a microprocessor controller which provides output signals to the motor driven apparatus within chair base 40, height expander 42 and back adjuster 26 to energize the motor driven apparatus therein in accordance with a predetermined motion profile. In addition, control panel 45 provides user input capability to controller 50 which, for example, may determine the motion profile selected and the time duration and amplitude constraints upon the motion profile. In accordance with an important aspect of the present invention, controller 50 operates to provide motion profiles for work station 10 which are extremely gradual and preferably undetectable by the user but which cycle the user through a variety of position changes over an extended period of time. It has been found that the use of long term imperceptible or slightly perceptible motion changes in the configuration of the work station provide substantial reduction of the various repetitive motion or limited motion difficulties encountered in work stations lacking this slow programmed motion capability. Thus, for example, controller 50 produces output signals applied to chair base 40 which slowly move chair base 40 and therefore chair 20 and the operator seated therein in the directions indicated by arrows 60 toward desktop 13 or away from desktop 13 thereby producing slow barely perceptible or imperceptible changes in the distance between chair 20 and desktop 13. These slow long term changes are not disturbing to the user but provide substantial changes of the user's physical position when seated in chair 20 working at desk 11. Similarly, controller 50 further provides motion profile signals to height adjuster 42 which energizes adjuster 42 to move chair 20 vertically in the directions indicated by arrows 61. Thus, with long term slow imperceptible or barely perceptible changes of the seating height of chair 20, the vertical distance to desktop 13 and the seat to floor distance imposed upon the operator seated in chair 20 is gradually changed taking the user through an extended motion change without disturbing the user in any manner. similarly, controller 50 produces motion profile signals applied to expander 30 which pivot back support 24 about pivot 25 with respect to seat 21 thereby changing the support angle of back 23 in the pivotal directions indicated by arrows 62. Once again, it should be emphasized that the motion profile preferred in moving back adjuster 26 to produce angular changes of seat back 23 is that of a slow imperceptible or barely perceptible rate of change which over a long term takes the user through a substantial variation of physical positions.

Thus, in the embodiment of the present invention set forth in FIG. 1, controller 50 produces a plurality of motion profile signals which control otherwise conventional work station adjustment apparatus such as height adjuster 42, chair base 40 and back adjuster 26 to cycle the operator through a plurality of work station configuration changes which avoid or substantially minimize the difficulties to the work station user arising from fixed position work station use. It will be apparent to those skilled in the art that the fabrication of the movable units within the present invention system is well within the state of the art and need not be set forth in greater detail herein. In essence, chair base 40, height adjuster 42 and back adjuster 26 may comprise virtually any of the presently available motor driven work station adjustment units presently utilized such as those set forth in the above-referenced patents described and referred to in the background of the invention.

In its simplest form, controller 50 provides a source of position signals which are varied in accordance with long term motion profiles such as those set forth below in FIG. 4 to control height adjuster 42 in cycling the chair height of chair 20, chair base 40 in cycling the chair to desk horizontal distance of work station 10, and back adjuster 26 in cycling the angle of back 23 of chair 20.

It will be apparent to those skilled in the art that controller 50 may utilize conventional control systems (not shown) in providing motion profile signals of the type utilized in the present invention. It will be equally apparent to those skilled in the art that a variety of different control systems may be utilized for controller 50 without departing from the spirit and scope of the present invention. It will also be apparent to those skilled in the art that because the present invention work station system may be utilized in combination with a great variety of position adjustable work stations, the work station shown in FIG. 1 is merely illustrative and other types of position adjustable work station elements may be utilized without departing from the spirit and scope of the present invention.

Figure 2:
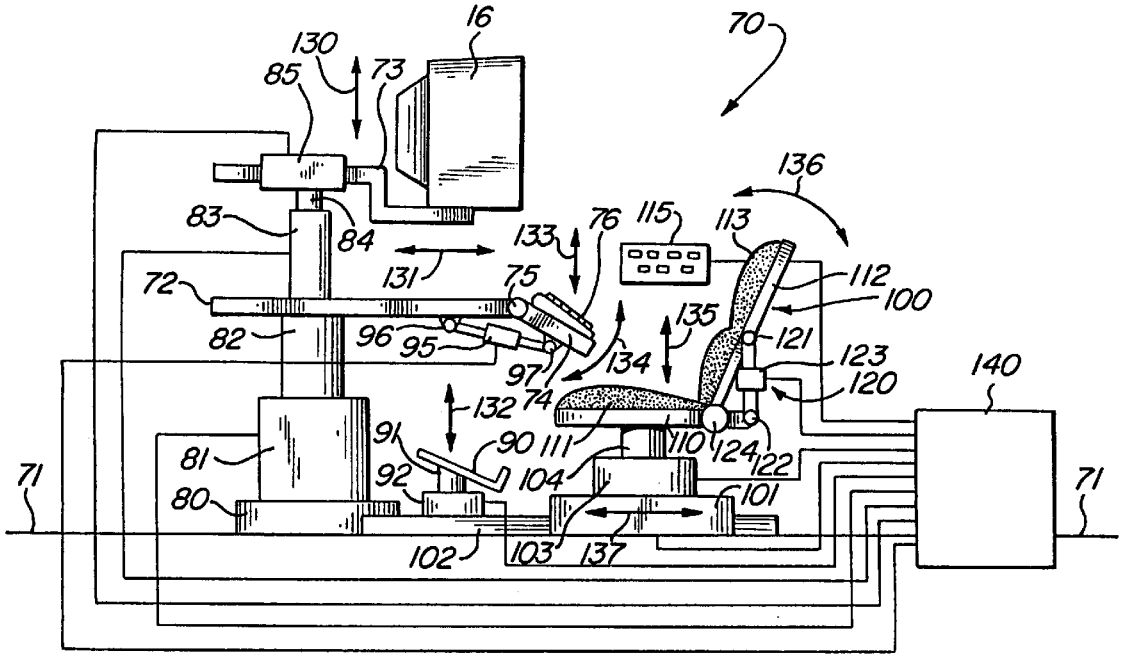
FIG. 2 sets forth a diagrammatic representation of an alternate embodiment of the present invention programmed motion work station.

FIG. 2 sets forth a more complex embodiment of the present invention programmed motion work station generally referenced by numeral 70. Work station 70 is supported upon a floor 71 and represents a typical computer work station utilizing the present invention system. A table base 80 is supported upon floor 71 and supports an upwardly extending table height adjuster 81. A table support 82 is coupled to height adjuster 81 and supports a planar work table 72. Work table 72 includes a keyboard support 74 coupled to work table 72 by a pivotal attachment 75. A keyboard adjuster 95 is coupled to the underside of work table 72 by a pivotal attachment 96 and is coupled to keyboard support 74 by a pivotal attachment 97. A conventional keyboard 76 is secured to and supported by keyboard support 74 in accordance with conventional fabrication techniques.

A monitor height adjuster 83 is secured to work table 72 and is coupled to a vertically extending support 84. A monitor lateral adjuster 85 is secured to support 84 and receives a monitor support 73.

A footrest height adjuster 92 is supported upon floor 71 and includes an upwardly extending support 91 having an angled generally planar footrest 90 supported thereupon.

A chair 100 includes a chair base 101 secured to a chair track 102 which in turn is secured to floor 71. Chair base 101 is operatively coupled to chair track 102 to provide motion of chair base 101 with respect to track 102. A chair height adjuster 103 is supported upon base 101 and is coupled to a chair support 104. The latter is coupled to a seat support 110 which supports a conventional seat ill. Chair 100 further includes a back support 112 supporting a chair back 113 which is pivotally coupled to seat support 110 by a pivotal attachment 124. A chair back adjuster 123 includes an expandable adjuster 120 secured to back support 112 by a pivotal attachment 121 and secured to seat support 110 by a pivotal attachment 122.

A controller 140 includes a control panel 115 coupled to controller 140. In accordance with the present invention, is operatively coupled to monitor lateral adjuster 85, monitor height adjuster 83, keyboard adjuster 95, table height adjuster 81, footrest height adjuster 92, chair base 101, chair height adjuster 103 and chair back adjuster 123.

Figure 4:
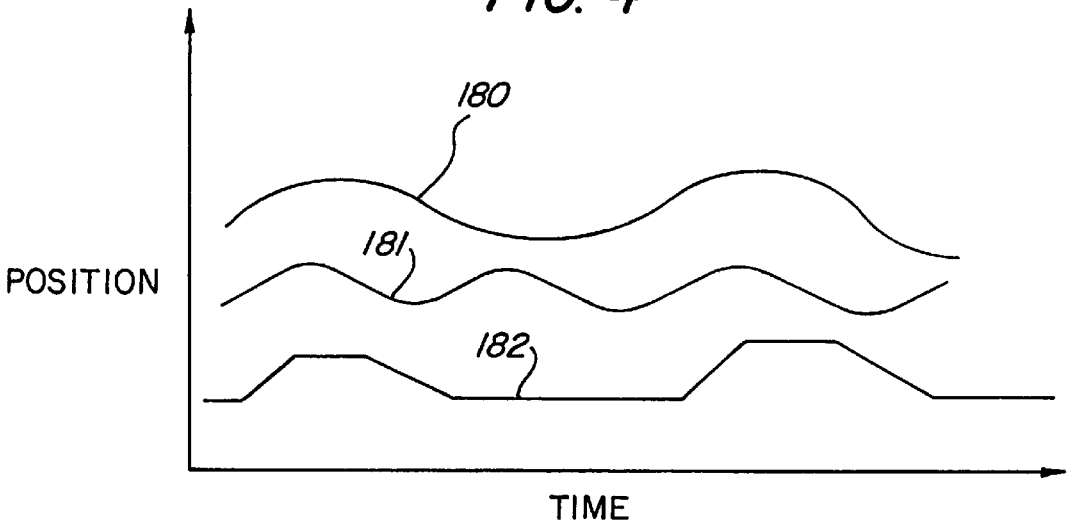
FIG. 4 sets forth a plurality of motion profile diagrams used in the present invention programmed motion work station.

In operation, controller 140 produces a plurality of motion profile signals such as those shown in FIG. 4 which are applied to the various motor driven adjusters within work station 70 to produce the above-described long term barely perceptible or imperceptible changes in the configuration of work station 70. The degree of motion changes and rate of motion change for each of the adjustable elements within work station 70 may be determined by user inputs at control panel 115. Alternatively, a stored program of motion profile signals may be housed within controller 140 and applied to the various expandable elements or adjusters within work station 70 on an automatic or preprogrammed basis or in accordance with a user selected program. In any event, the control signals provided by controller 140 applied to table height adjustment 81 provides height adjustment of work table 72. Similarly, the motion profile signals from controller 140 applied to monitor height adjuster 83 provides vertical motion of monitor 16 in the directions indicated by arrow 130.

Signals from controller 140 applied to monitor lateral adjuster 85 provide horizontal motion of monitor 16 in the directions indicated by arrows 131. In a similar fashion, the angular position of keyboard support 74 is changed in the directions indicated by arrows 134 as controller 140 applies motion profile signals to keyboard adjuster 95.

Motion profile signals applied by controller 140 to footrest height adjuster 92 produce vertical motion of footrest 90 in the directions indicated by arrows 132. Thus, in accordance with the present invention, the configuration of work table 72, keyboard 76, monitor 16 and footrest 90 are subjected to substantial relative variations as the expandable motor driven adjusters therein respond to the control signals provided by controller 140.

Chair 100 is subjected to similar motion profile configuration changes as controller 140 applies motion profile signals to chair base 101 moving chair 100 in the directions indicated by arrows 137 upon track 102. In addition, the application of motion profile signals by controller 140 to chair height adjuster 103 and back adjuster 120 provide long term changes of the height of chair 100 in the directions indicated by arrows 135 as well as the angular position of chair back 113 in the directions indicated by arrows 136.

Thus, as controller 140 produces long term motion profile signals applied to the various adjusters within work station 70, the entire configuration of work station 70 may be cycled through imperceptible or barely perceptible motion and configuration changes to improve the well being of the work station user. It will be apparent to those skilled in the art that a variety of motion profile combinations may be utilized in the present invention system to meet the user's need. For example, particular users may require greater movement and position changes of chair 100 while other users may require substantially smaller motions. It should be noted that the use of monitor 16 and keyboard 76 in work station 70 is representative of a typical computer work station. However, it will be apparent to those skilled in the art that a variety of similar apparatus may be utilized in work station 70 while receiving the benefit of the present invention system.

Figure 3:
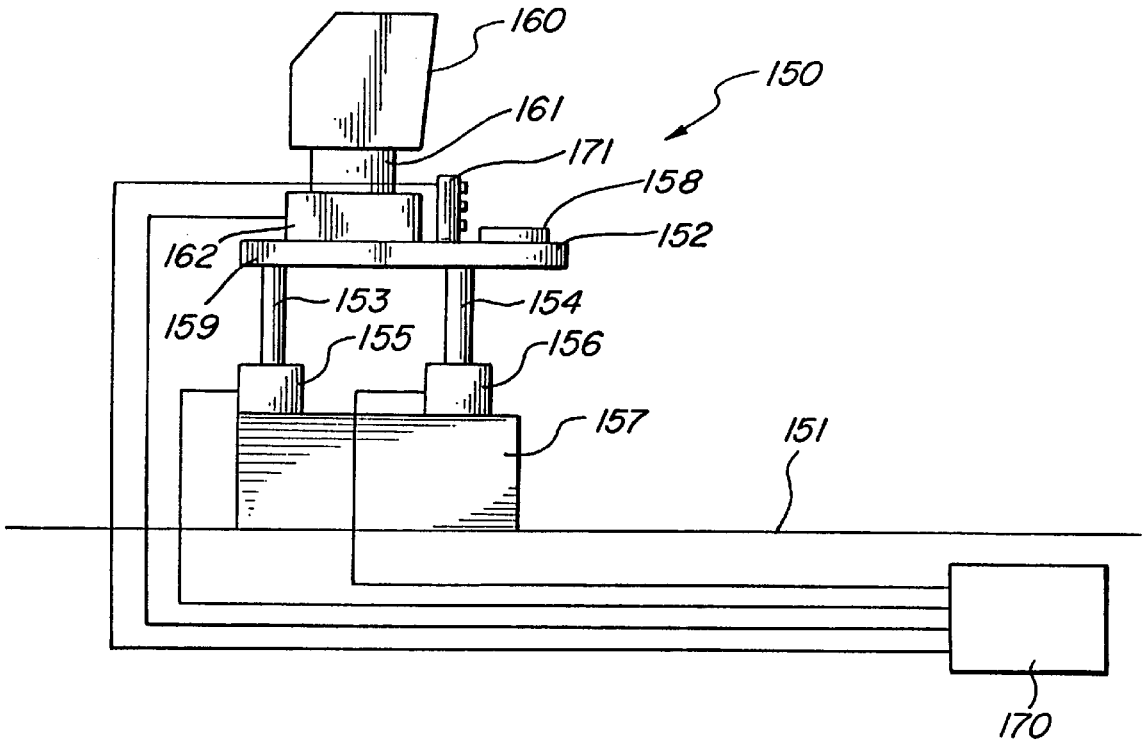
FIG. 3 sets forth a diagrammatic representation of a still further alternate embodiment of the present invention programmed motion work station.

FIG. 3 sets forth a still further alternate embodiment of the present invention in which a "stand-up" type work station is shown generally referenced by numeral 150. Work station 150 is stand-up in the sense that the operator generally operates the work station from a standing position upon a typical floor 151. Thus, work station 150 is representative of many manufacturing and testing type work stations and includes a table 152 having a base 157 supporting a pair of height adjusters 155 and 156. Height adjusters 155 and 156 in turn are coupled to a pair of supports 153 and 154 which in turn supports a generally planar work table 159. Work table 159 supports a monitor height adjuster 162 having a monitor support 161 supported thereby. A display monitor 160 is received upon and supported by monitor support 161. A control panel 171 is supported upon work table 159 and is coupled to a controller 170. An exemplary work piece 158 is rested upon the upper surface of work table 159 at a typical working position for the work station operator. Controller 170 is operatively coupled to table height adjusters 155 and 156 as well as monitor height adjuster 162.

In operation, the stand-up work station embodiment shown in FIG. 3 functions in substantial accord with the above-describe embodiments in FIGS. 1 and 2. Thus, controller 170 produces a plurality of long term motion profiles signals which are applied to table height adjusters 155 and 156 to change the height of work table 159 in accordance with a gradual long term motion profile. Similarly, controller 170 provides motion profile signals to monitor height adjuster 162 to provide gradual long term vertical motion of monitor 160. Control panel 171 is utilized by the work station operator in setting upon the motion profile limits and character utilized by motion controller 170. Thus, it will be apparent from examination of FIG. 3 that the present invention programmed motion work station may be utilized in a stand-up environment of the type typically found in manufacturing work stations.

FIG. 4 sets forth a plurality of motion profile signals of the type utilized by the controller portions of the present invention programmed motion work station. In the diagram shown in FIG. 4, time is represented on the horizontal axis while position is represented on the vertical axis. Thus, for example, a sinusoidal motion profile 180 extending over a substantial length of time may be utilized as one of the motion profiles imposed by the controller portion of the present invention programmed motion work station. Sinusoidal variations have been found to be advantageous in that they lend themselves extremely well to long term gradual imperceptible changes which avoid disturbing the work station operator. Curve 181 shows a triangular waveform motion profile in which generally linear oppositely sloped portions are alternated to produce a generally linear "back and forth or up and down" motion within the work station. Curve 182 sets forth a trapezoidal motion profile in which oppositely sloped portions are interrupted by a constant period or interval. It has been found that certain portions of the work station are best controlled by utilizing relatively brief transition slopes in the motion profile separated by periods of relatively little motion corresponding to flat portions in the motion profile.

A particular preferred embodiment comprises a continuous passive motion keypad for use on electronic systems requiring manual data entry via a keypad. A keypad may have keys such as the alpha characters, numeric characters, or keys designed for a particular operation. A particular type of keypad is the keyboard, which has a key layout similar to a typewriter, plus number and special function keys. The preferred embodiments are described for a keyboard, but those skilled in the art will recognize that the invention applies to keypads in general. The passive motion keyboard would operate with computers, cash registers, data entry machines, 10-key pads, or any other device requiring keypad or keyboard data entry. The continuous passive motion keyboard continuously changes the angle of the input keys of the keyboard relative to the keyboard user. Such a motion causes the wrists and the fingers of the keyboard user to change position continuously relative to the keyboard keys. This change in position relative to the keys assures that the keyboard user's hands do not remain in a stagnate position for an extended period, thus reducing the likelihood of a repetitive motion injury.

Figure 5:
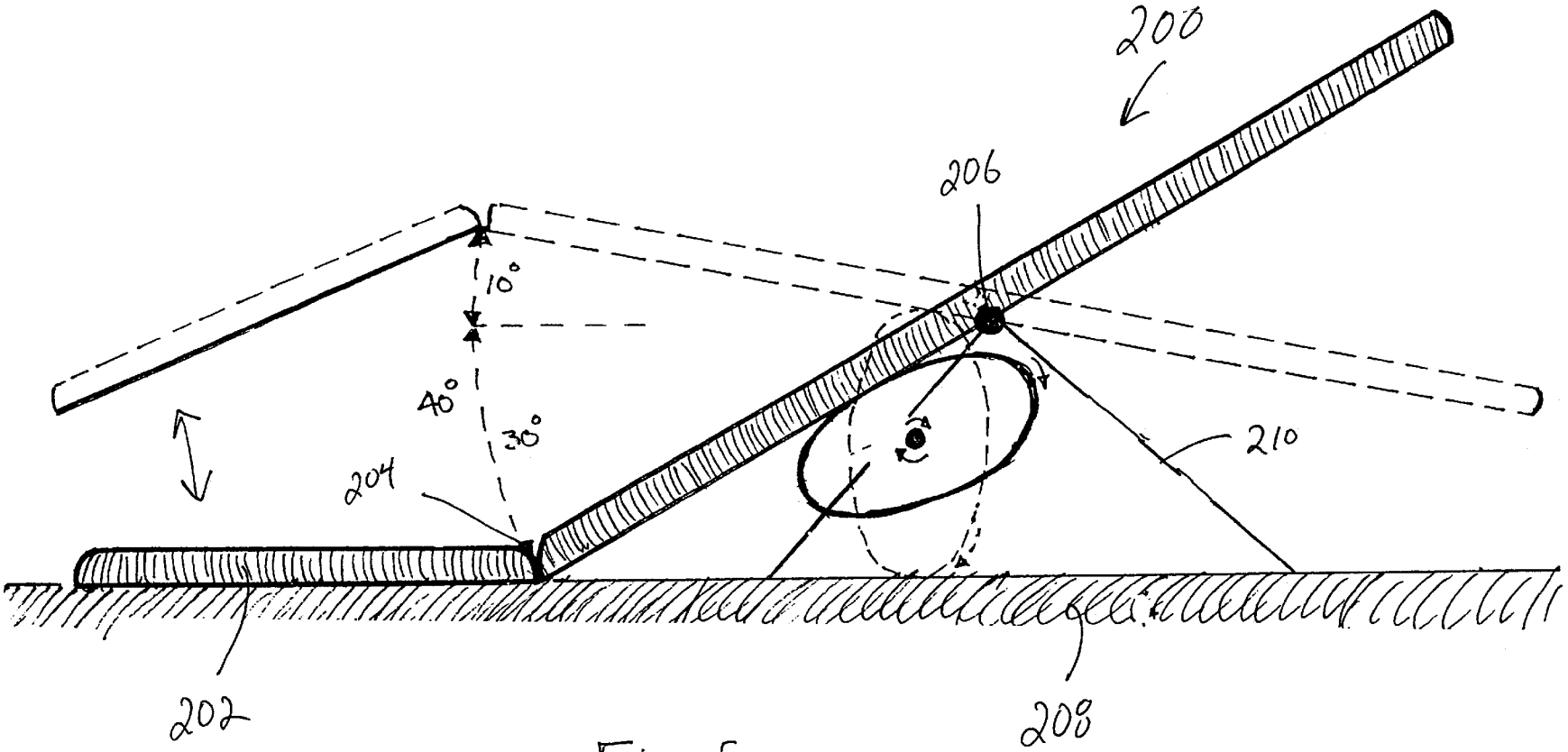
FIG. 5 sets forth a particular embodiment of a continuous passive motion keyboard.

FIG. 5 shows a continuous passive motion keyboard that minimizes the effect of carpal tunnel syndrome to a keyboard user. The keyboard of FIG. 5 provides a continuous motion whereby the angle of the keyboard relative to the user is continuously adjusted. The keyboard is at an initial angle relative to the user and continuously moves so the keyboard moves to another angle relative to the user. This angular adjustment occurs at a rate such that the user is not hindered in using the keyboard. The rate of this motion may be adjustable by an individual user. Through experimentation it was found that maximum protection against carpal tunnel syndrome is achieved by having the keyboard cycle through its continuous passive motion at the rate of 5 to 60 minutes per cycle. Of course those skilled in the art will readily recognize that other cycle times may achieve sufficient movement to protect against carpal tunnel syndrome. The motion of the keyboard 200 may also affect the angle of a wrist rest 202 relative to the user. The optional wrist rest 202 is hinged to the proximal end of the keyboard 200 by a hinge 204. As the keyboard pivots about a pivot point 206, the hinged end of the wrist rest 202 is raised above the platform 208, thus changing the angle of the wrist rest 202 relative to the user.

The pivot point 206 is located approximately in the center of the keyboard 200. Those skilled in the art will readily recognize that the pivot point 206 may be placed either toward or away from the proximal end of the keyboard and still maintain the utility of the passive motion keyboard, although it may produce slightly different motion patterns. The pivot point 206 is attached to keyboard supports 210 at each end of the keyboard. The keyboard supports 210 remain stationary and are attached to a platform 208. The platform is sized such that when the keyboard is at its at rest position, the hinged front of the keyboard rests against the platform 208. Further, the platform is sized to hold the keyboard support 210 and the rotating mechanisms which will be discussed below. Those skilled in the art recognize that there are many configurations for the platform that are within the bounds of the present invention.

The motion provided by this preferred embodiment is a continuous passive motion which continuously changes the angle of the keyboard relative to the user. Such continuous motion causes the users wrists and hands to gradually change position, thus relieving stress and maintaining proper circulation. The continuous passive motion comprises one or more cycles wherein the keyboard moves from an initial position through a cycle of motion and is brought back to its initial condition.

Figure 6:
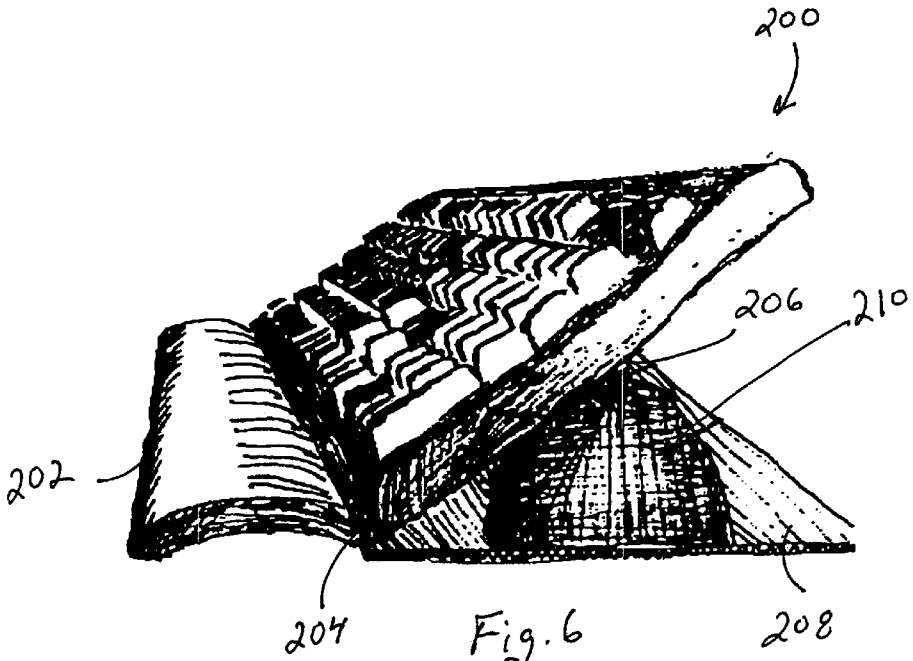
FIG. 6 sets forth a prospective view of the continuous passive motion keyboard shown in FIG. 5.

FIG. 6 shows the passive motion keyboard in its initial position such that the hinge 204 is resting on the platform 208 with the wrist rest 202 extending laterally forward from the hinge. The keyboard supports 210 are shown resting on the platform 208 with the keyboard supports 210 connecting to the pivot point 206 on the keyboard 200.

Figure 7:
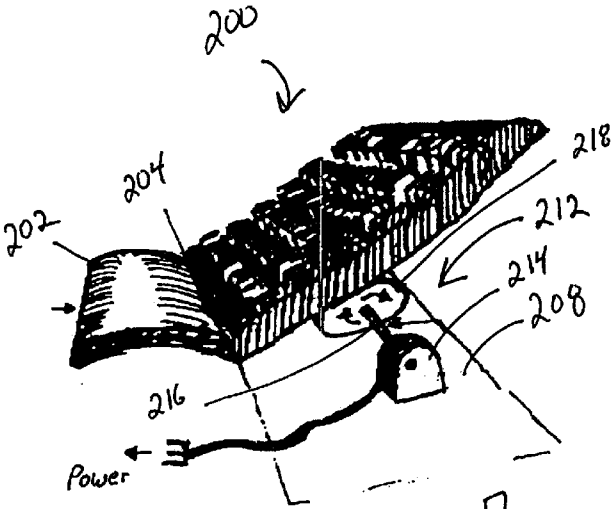
FIG. 7 is a cut-away view of the continuous passive motion keyboard of FIG. 5.

FIG. 7 is a cross-sectioned view of the passive motion keyboard shown in FIGS. 5 and 6. With half the keyboard and wrist rest removed and one of the keyboard supports removed, it is possible to see the rotating mechanism 212 mounted on the platform 208. The rotating mechanism 212 comprises a motor gearbox 214, a cam driver 216, and a cam 218. The cam 218 is a moving member for continuously moving the keyboard so the angle relative to the user is continuously changed. Those skilled in the art will readily recognize that different sizes and shapes would work equally well for the cam to provide a continuous passive motion and further that a combination of cams or cams and gears may be used to provide a similarly effective motion. Additionally, such a continuous motion could be provided by pneumatics or other types of ram systems.

The motor gearbox 214 is electrically connected to a power source. This power source may be an independent power source such as from a power transformer or the power source may be connected directly to the power lines which normally connect a keyboard to a computer or other device. If the power source is connected directly to the power source already available from the keyboard connection line, then the electric motor will be activated when the keyboard is powered during the normal computer boot-up process. When the computer or other device is shut down, the electrical source is removed from the electrical motor.

If the continuous passive motion keyboard power source is independent from the underlying computer, then the power source is switched such that the motor gearbox 214 only operates when the switch is activated. Those skilled in the art will readily recognize that the use of switches to control the operation of such a physical motion is well known. The switch may be activated manually by a user or alternatively the switch may detect when the keyboard is in use and activate the motor only while a user is actively typing on the keyboard.

The motor gearbox 214 contains a gear reduction mechanism such that the rotational speed is adjustable as to the number of rotations the cam will make per hour. The cam driver 216 connects to the motor gearbox 214 and is attached to the cam 218. The cam drive 216 ends in a cam driver support that assists in retaining the cam driver in a steady position. The surface of the cam 218 rests against and contacts the back of the keyboard 200. Those skilled in the art recognize that the interface between the cam 218 and the keyboard 200 may be accomplished in several ways including a butt surface, a roller surface, a bearing surface, or the use of surfaces that readily slip relative to each other.

The cam 218 is elliptical in shape thus providing the necessary variation in motion to provide the continuous passive motion. As the cam driver 216 is rotated by the motor gearbox 214, the cam 218 is rotated through a continuous motion cycle such that the hinged end of the keyboard moves from its initial at rest position to a position parallel with the platform, then continuing 10 degrees beyond the parallel position. The hinged end of the keyboard then reverses direction and continues back to the initial position. Those skilled in the art will readily recognize that other ranges of motion are available and that other shapes for the cam may provide different but equally effective continuous motion.

In use the operator turns on the continuous passive motion keyboard by either typing or activating a switch to turn on the motor gearbox or if the motor gearbox is powered by the computer, simply turning on the computer. With the continuous motion keyboard activated the motor gearbox rotates the cam driver 216 causing the cam 218 to similarly rotate. Those skilled in the art will recognize that other speeds of rotation provide effective passive motion.

As the cam rotates through its cycle, the hinged edge of the keyboard will be raised and lowered, changing the angle of keyboard 200 relative to the user of the keyboard. Further, the wrist rest 202 which is hinged to the keyboard 200 will likewise move thus adjusting the wrist angle of the user. The hinged end of the wrist rest rises and falls with the hinged end of the keyboard, with the unhinged side of the wrist rest first resting upon the platform 208 or other support then sliding across the table or platform as the hinged end of the keyboard is raised, and finally rising completely off the platform or other support so as to be suspended in the air. Those skilled in the art will recognize that other angles and motion are available that provide similar results.

Additionally, those skilled in the art will recognize that although this embodiment shows the cam driving the keyboard directly this same passive motion keyboard system may be implemented when a standard keyboard is placed on a support to which the pivot and cam interact.

Figure 8B:
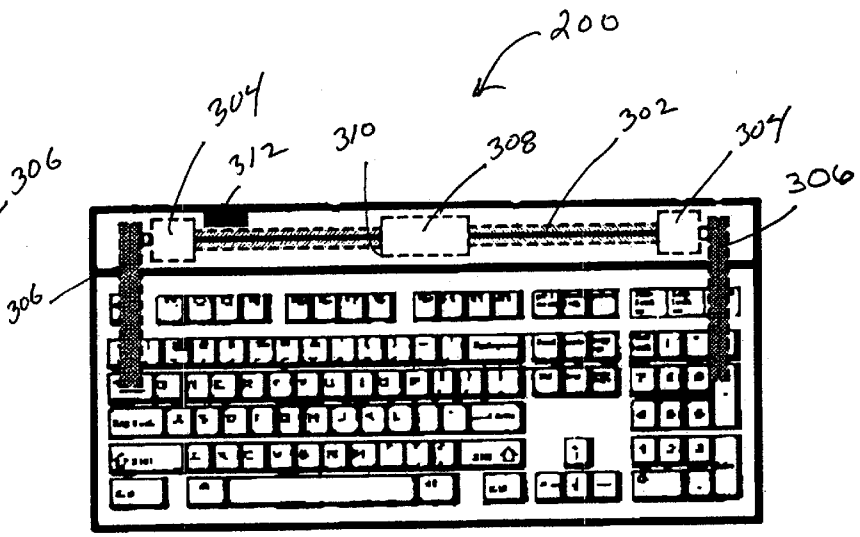
FIG. 8 sets forth an alternative preferred embodiment for the continuous passive motion keyboard including an electrical and spring-operated versions.
Figure 8D:
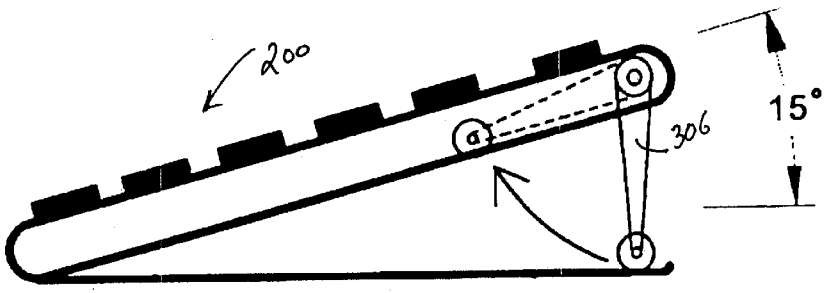
Figure 8A:
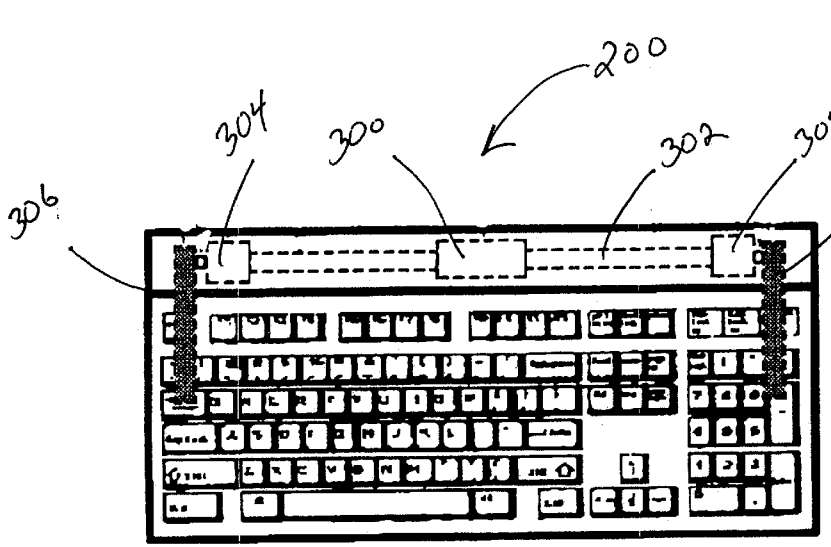
Figure 8C:
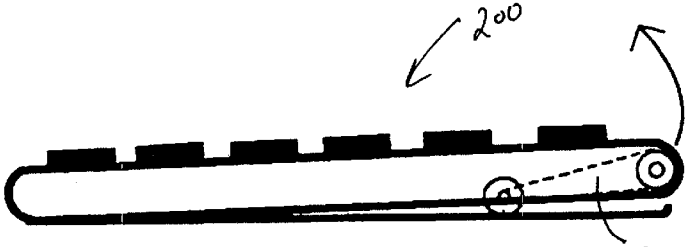

Turning now to FIG. 8A, an alternative preferred embodiment of a passive motion keyboard is shown. This shows a passive motion keyboard having an electric motor 300 driving a driveshaft 302 which in turn drives a modulating gearbox 304. The modulating gearbox 304 reduces the rate of rotation from the electric motor to drive a driveshaft 302 at a rotation rate that may be adjustable by the user or preset by the manufacturer. As shown in FIG. 8A, the electric motor rotates in the first direction to extend the legs and reverses direction to retract the legs. Alternatively, the motor could rotate in a single direction with an elliptical cam connected to the driveshaft which would first extend the legs and then retract the legs. Those skilled in the art will recognize that alternatives exist for adjusting the rotational rate of the electrical motor to the desired passive motion rate. The use of the cam allows the retractable legs 306 to first extend away from the keyboard 200 and then retract towards the keyboard 200. FIG. 8C shows the legs retracted into the keyboard and FIG. 8D shows the legs extended from the keyboard. This continuous up and down motion provided by the cam continuously adjusts the angle of the keyboard 200 relative to the user. The preferred embodiment uses a cam to reverse the direction of the retractable legs 306. Alternatively, a simple circular cam may connect to retractable legs 306 and a switch used to reverse the direction of the electric motor when the legs reach a fully retracted or fully extended position, thus, acting to reverse the direction of the retractable legs 306. In this configuration, the continuous motion is stopped when the legs are fully retracted and extended and the motion is reversed. Thus, the continuous motion of the present invention may be cyclical as with the elliptical cam mechanism described above, or the motion may have discrete endpoints.

FIG. 8B shows a variation of the preferred embodiment discussed above. Here the passive motion workstation uses a spring 308 which is connected to a spring anchor 310 with the spring 308 used to power a modulating gearbox 304. The modulating gearbox 304 is used gradually to apply forces retained within the spring 308 to the retractable legs 306 thus allowing the legs to extend over a period of time. The legs 306 are movable members attached to the body of the keyboard, with the keyboard acting as the platform from which the legs pivot. With the retractable legs 306 in a fully extended position the spring 308 has little or no tension on it and the keyboard is at its highest angle 15 degrees relative to the platform. At this point, an indicator window flag 312 is shown to the user as a visual warning that the passive motion is complete. Alternatively the keyboard may contain a LED which is lit once the retractable legs have reached maximum extension. With the legs fully retracted the user then manually presses the keyboard towards the platform.

Under the pressing force the retractable legs are pushed toward and into the keyboard and the spring placed under tension. Additionally, the indicator window flag 312 or indicator LED is removed. When the operator has completed pressing the keyboard down, the user resumes typing. The tension on the spring is now accepted by the modulating gear box 304 which causes the retractable leg 306 to begin extending, thus raising the keyboard relative to the platform.

Modern computer equipment not only utilizes a keyboard for user input, but often requires the user to manipulate a graphical device commonly known as a mouse. A mouse is typically a hand-held device which the computer user manipulates to position a cursor on the computer monitor. The mouse is generally used on a low-slip surface to both assist in accurately positioning the graphical cursor and for keeping the mouse clean. This low-slip surface is commonly referred to as a mouse pad. For convenience, the user typically positions the mouse pad and mouse proximate the keyboard. As with extended use of the keyboard, the extended use of a mouse may contribute to a repetitive stress injury. It is therefore advantageous for the mouse and mouse pad to be adjusted relative to the mouse user.

In an alternate preferred embodiment, the keyboard has a platform extension on which a mouse pad may be placed. As the keyboard and the extension are attached, both the keyboard and the extension will move relative to the user at the same rate. Therefore, a mouse user will benefit from the continuous passive motion that is already applied to the key section of the keyboard.

Alternatively, the mouse pad may be supported by an independent platform. This mouse platform may have any of the drive mechanisms discussed above in reference to the continuous passive motion for the keyboard.

It will be apparent to those skilled in the art that a variety of motion profile signals may be generated by the controller portion of the present invention programmed motion work station without departing from the spirit and scope of the present invention. It will be equally apparent to those skilled in the art that a variety of motion profile combinations and amplitudes as well as motion profile durations may be utilized within the system in accordance with the particular needs of the user and the work station environment itself.

What has been shown is a programmed motion work station in which a plurality of generally conventional adjusters are operated under the control of a motion profile controller which applies gradual long term motion profile signals to the various adjustable elements within the work station environment. The objective is to provide gradual long term preferably imperceptible variation of the work station geometry and configuration in order to avoid various maladies arising from limited or restricted motion in work station environments. Further, a passive motion keyboard has been shown that continuously adjusts the position of a keypad or mouse pad support relative to a keyboard user.

While particular embodiments of the invention have been shown and described, it will be obvious to those skilled in the art that changes and modifications may be made without departing from the invention in its broader aspects. Therefore, the aim of the appended claims is to cover all such changes and modifications as fall within the true spirit and scope of the invention.

What is claimed is:

1. A continuous passive motion keypad for use by a keypad user, comprising:

a platform;

a keypad having an initial angle relative to the keypad user;

a moving member operably coupled to the platform and keypad for imparting continuous angular movement of said keypad between an initial angle and another angle;

a controller operatively coupled to the moving member, said controller adapted to produce a plurality of motion profile signals to be applied to said moving member to move said keypad in a plurality of corresponding motion profiles;

a control panel coupled to the controller, the control panel including user input for changing the rate of motion for the keypad.

2. A continuous passive motion keypad for use by a keypad users comprising:

a platform;

a keypad having an initial angle relative to the keypad user;

a moving member operably coupled to the platform and keypad for imparting continuous angular movement of said keypad between an initial angle and another angle;

a controller operatively coupled to the moving member, said controller adapted to produce a plurality of motion profile signals to be applied to said moving member to move said keypad in a plurality of corresponding motion profiles;

a control panel coupled to the controller, the control panel including user input for changing the degree of motion of said keypad.

3. A continuous passive motion keypad for use by a keypad user, comprising:

a platform;

a keypad having an initial angle relative to the keypad user;

a moving member operably coupled to the platform and keypad for imparting continuous angular movement of said keypad between an initial angle and another angle;

a controller operatively coupled to the moving member to cause said moving member to move said keypad in a sinusoidal waveform motion profile.

4. A continuous passive motion keypad for use by a keypad user, comprising:

a platform;

a keypad having an initial angle relative to the keypad user;

a moving member operably coupled to the platform and keypad for imparting continuous angular movement of said keypad between an initial angle and another angle;

a controller operatively coupled to the moving member to cause said moving member to move said keypad in a triangular waveform motion profile.

5. A continuous passive motion keypad for use by a keypad user, comprising:

a platform;

a keypad having an initial angle relative to the keypad user;

a moving member operably coupled to the platform and keypad for imparting continuous angular movement of said keypad between an initial angle and another angle;

a controller operatively coupled to the moving member to cause said moving member to move said keypad in a trapezoidal waveform motion profile.

* * * * *